United States Patent [19]

Stevens

[11] 3,949,445

[45] Apr. 13, 1976

[54] CONNECTOR LEAF AND LEAF ASSEMBLY

[75] Inventor: John R. Stevens, Seattle, Wash.

[73] Assignee: Harlan B. Dean, Seattle, Wash.

[22] Filed: May 27, 1975

[21] Appl. No.: 580,670

[52] U.S. Cl. ..... 16/128 R; 16/173

[51] Int. Cl.[2] ..... E05D 9/00; E05D 15/00

[58] Field of Search..... 16/128 R, 170, 171, 173, 16/162, 163, 135, 157, 176

[56] References Cited

UNITED STATES PATENTS

| | | | |
|---|---|---|---|
| 61,421 | 1/1867 | Hancock | 16/170 |
| 1,192,989 | 8/1916 | Clifford | 16/173 |
| 1,375,212 | 4/1921 | Crone | 16/128 R |
| 1,416,812 | 5/1922 | Freyberg et al. | 16/128 R |
| 3,828,476 | 8/1974 | Ienenbaum et al. | 16/128 R |

*Primary Examiner*—G. V. Larkin

*Attorney, Agent, or Firm*—Seed, Berry, Vernon & Baynham

[57] ABSTRACT

A connector leaf for cooperating with a like leaf as an assembly for detachably connecting panels or other structures together comprises a generally rectangular planar body having a pair of knuckles at its opposite ends, each with an axial bore therethrough for receiving a connector pin. The knuckles are flush with one face of the body and project outwardly of the other face thereof. In the preferred embodiment, the knuckles are at diagonally opposite corners.

11 Claims, 5 Drawing Figures

FIG. 1
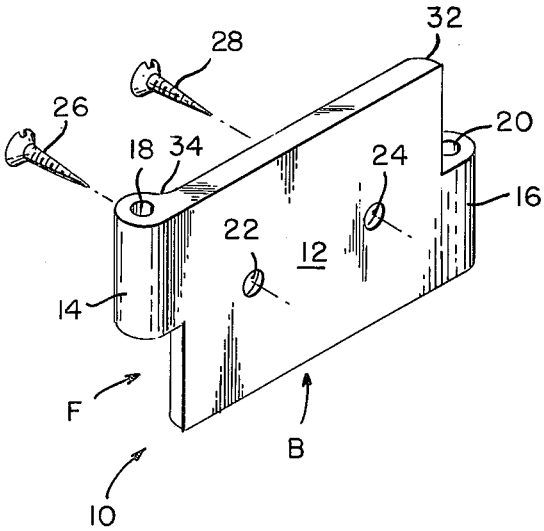
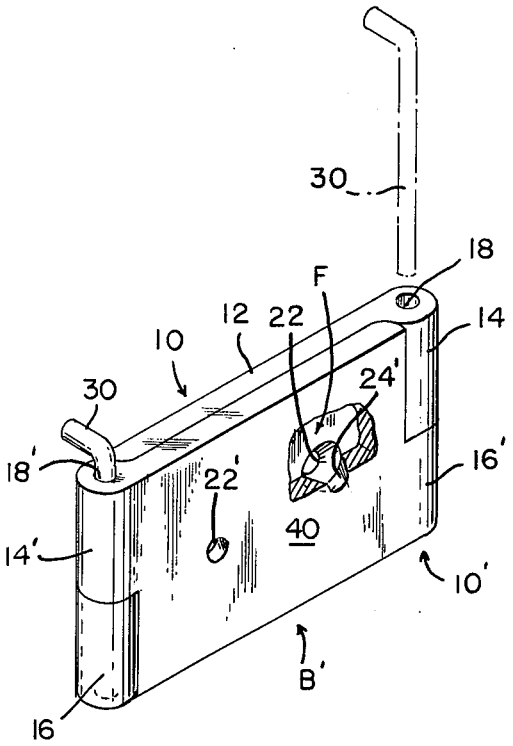
FIG. 2
FIG. 3
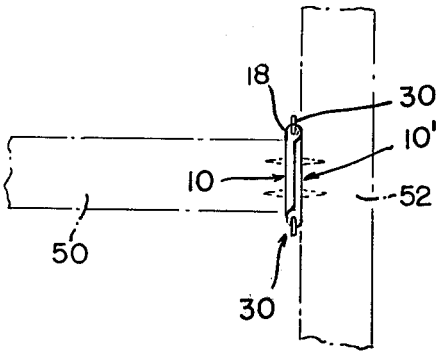
FIG. 4
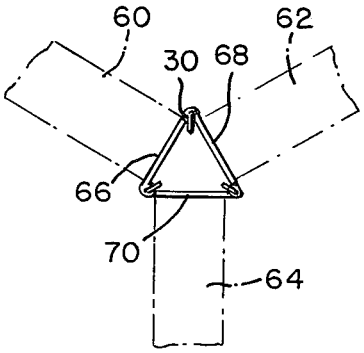
FIG. 5
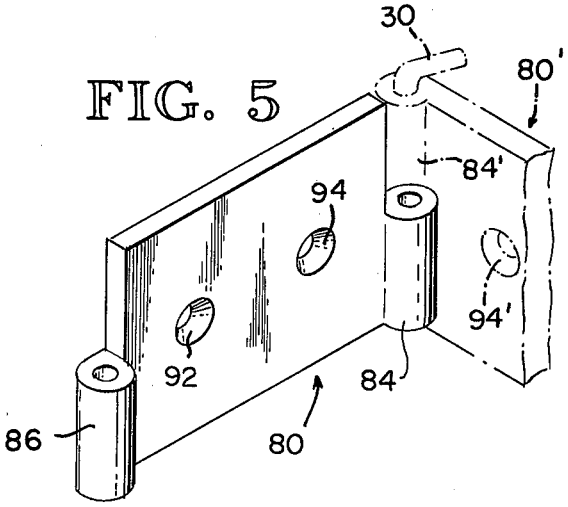

CONNECTOR LEAF AND LEAF ASSEMBLY

FIELD OF THE INVENTION

This invention relates to structural connectors, and more particularly, to a connector leaf for cooperating with a like leaf for detachably connecting panels or other structures together, either in fixed relation or for horizontal angular adjustment.

NEED FOR THE INVENTION

Panels or screens for dividing interior areas of buildings into a plurality of rooms, zones or cubicles are in relatively common use, particularly in office buildings. After the dividers have been initially positioned, it is often desired to modify the arrangement from time to time in order to better accommodate the changing needs of the building occupants. Such a modification cannot be readily accomplished by many of the panel mounting systems in use. Others require complicated or unsightly hardware, and most do not permit horizontal angular adjustment of the panels.

SUMMARY OF THE INVENTION

The present invention aims to provide a connector leaf for panels, screens, dividers, portable walls and the like, all of which will hereinafter be termed "panels," which can be easily fastened in place and does not require modification of the structure in which it is fastened.

Another object of the invention is to provide a connector leaf which, when used in multiple, allows quick and easy interconnection of multiple panels in a wide variety of arrangements and without the need for skilled manpower.

A further object is to provide a connector leaf assembly for joining panels which permits them to be easily disconnected and rearranged.

These and other objects are accomplished by providing a novel connector leaf which can be arranged in multiple and connected one to another by removable pins.

In the preferred embodiment, the connector leaf has a generally rectangular body with diagonally opposite knuckles. The leaves are nested with adjoining knuckles aligned and abutting to receive respective pins. Tapered holes are provided in the leaf body in symmetrical relation to receive mounting screws or the like.

BRIEF DESCRIPTION OF THE DRAWINGS

FIG. 1 is an exploded perspective view of a connector leaf and suitable fastening screws, as seen from the rear, of the preferred embodiment of the invention;

FIG. 2 is a perspective view similar to FIG. 1 and showing a pair of the connector leaves nested together front face to front face, with one of the leaves partly broken away at one of the screw holes;

FIG. 3 is a top plan view illustrating two panels in phantom connected at right angles by a pair of the connector leaves nested in the manner shown in FIG. 2;

FIG. 4 is a top plan view showing three of the connector leaves of FIG. 1 connected together to join three panels shown in phantom; and FIG. 5 is a perspective view of a modified connector leaf shown connected to a like leaf illustrated fragmentarily in phantom.

DETAILED DESCRIPTION OF THE PREFERRED EMBODIMENT

Referring to FIG. 1, in the preferred embodiment, denoted 10, the connector leaf has a planar, generally rectangular body portion 12 formed with a pair of diagonally opposite pairs of knuckles 14, 16 having axial through-bores 18, 20. The body portion 12 also is formed with a pair of tapered screw holes 22, 24 which are preferably located on the major axis and spaced apart equally from the minor axis of the body portion so that the holes, as well as the knuckles, perfectly exchange positions when the leaf is turned 180°. There is not any significance as to which diagonal of the body portion has the knuckles as long as the connector leaves which are to be used together are the same. It is also preferred that the inner ends of the knuckles 14, 16 be located on the major axis in alignment with the holes 22, 24.

It will be noted that the back surfaces of the knuckles 14, 16 are flush with the back face B, and that the front surfaces of the knuckles extend forwardly beyond the plane of the front face F of the body portion. Preferably, this forward extension of the knuckles does not exceed the thickness of the body portion 12. In the illustrated embodiment 10, the knuckle extension is equal to the body thickness, and the axis of each of the knuckle bores 18, 20 is coplanar with the plane of the front face F. The end portions of the body 12 adjoining the inner ends of the knuckles are preferably convexly curved as indicated at 32 to conform with the concave curvature 34 at the juncture of the knuckles and the front face F.

As shown in FIG. 2, a pair of the leaf connectors 10–10′ will perfectly nest together, front face against front face, and the bores of the adjoining knuckles 14, 16′ and 14′, 16 will be aligned to receive respective connector L-pins 30. When one of these pins is used, the connector leaves become hinged together at the pin location and are free to swing relative to one another about the pin axis. The use of two pins completely locks the leaves together. It is important to note that the lower knuckle of each leaf gives vertical support for the adjoining upper knuckle of the other leaf.

Screws 26, 28 are provided, having the underside of their heads tapered to match the taper of the holes 22, 24 so that the outer faces of the screw heads will be flush with the front face F when the screws are used to mount the connector leaf in place on a panel or wall.

In FIG. 3, a panel 50 is shown rigidly connected at one end at right angles to a sidewall of a panel 52 by a pair of connector leaves 10–10′ and two pins 30, the leaves being in the same face-to-face position as shown in FIG. 2. If one of the two pins 30 is removed, it is apparent that the panel 50 can then be swung to any desired position relative to the panel 52. Depending on the height and weight of the panels, normally two or more sets of the connector leaves are used at various elevations.

For purpose of example, in FIG. 4 a set of three of the afore-described connector leaves 10, denoted 66, 68 and 70 in this view, are shown mounted at the same level on the ends of three adjoining vertical panels 60, 62 and 64 which are spaced 120 degrees apart. The knuckles of the leaf connectors are coupled together in a triangular configuration with three of the L-pins 30. As a consequence, the three panels are locked against relative movement horizontally and vertically. It will be apparent that four panels can be held spaced apart by 90 degrees by the use of four connector leaves coupled together in a square configuration rather than in the equilateral triangular configuration shown in FIG. 4. Hence, the preferred embodiment makes it possible to couple together an odd or even number of panels with their joined end faces arranged as sides of a regular polygon.

In FIG. 5, there is illustrated a second embodiment 80 of the connector leaf in which a pair of knuckles 84, 86 are placed directly opposite one another rather than diagonally opposite. Tapered screw holes 92, 94 are provided along the major axis as before. As indicated in phantom by the leaf 80' in FIG. 5, when two leaves of the second embodiment are coupled together by a pin 30, one of the leaves must be reversed 180 degrees relative to the other. Hence, although having many of the same advantages and uses as the preferred embodiment, this second embodiment can only be coupled in multiples of two, and hence cannot be used to connect three panels together in the manner illustrated in FIG. 4. Furthermore, care must be shown in mounting the connector leaves so that panels to be joined together will have the knuckles of their respective connector leaves 80 arranged one at the top and the other at the bottom. Hence, it is seen that the second embodiment, although having considerable utility, is not as versatile and easy to use as the preferred embodiment.

The front face of the connector leaf of either embodiment can be made flush to an end face of the panel on which the leaf is mounted by recessing the panel face the thickness of the body portion of the leaf. Also, as indicated in FIG. 3 by the leaf 10' on panel 52, a leaf can be placed with its back face, including the knuckles, coplanar with a sidewall of panel. This is the advantage of not having the knuckles extend forwardly of the front face F more than the thickness of the body portion 12. However, since the connector leaf of this invention has other important advantages independent of such coplanar mounting advantage, it is not limited to the illustrated arrangement wherein the knuckles project the thickness of the body portion.

The embodiments of the invention in which a particular property or privilege is claimed are defined as follows:

1. A leaf for connecting structures, comprising:

a relatively thin body having front and back planar faces, opposite ends, and a center line located between opposite lengthwise edges extending between said opposite ends, securing means for fastening said body against a structure with the back planar face abutting the structure, and a pair of longitudinally bored, parallel knuckles secured to said opposite ends of said body, each of said knuckles terminating adjacent the center line of the body, being flush with said back face, and extending forwardly of the front face such that a pair of said leaves are adapted to be nested front face to front face with the knuckles aligned and their confronting ends abutting each other.

2. A leaf as in claim 1 wherein said securing means comprises screw holes symmetrically placed along the center line of said body such that the location of screws for said holes will not change when said leaf is rotated 180°.

3. The leaf of claim 1 in which said knuckles are located on opposite sides of said center line.

4. The leaf of claim 1 in which said knuckles are located on the same side of said center line.

5. A connector assembly for joining panels or the like, comprising:

at least two like leaves, each having a body including lengthwise edges, opposite ends, opposite faces and a center line between said lengthwise edges, and each having a respective pair of knuckles secured to the opposite ends of its body and formed with longitudinal through-bores, said pair of knuckles being flush with one face of the respective leaf and extending outwardly relative to the opposite face thereof, adjacent knuckles of said leaves overlapping inner end to inner end at an intersection of the center lines of the leaf bodies and having their bores aligned, securing means for securing the leaves to the panels, and pin means in said aligned bores for detachably interconnecting the overlapped knuckles together.

6. A connector assembly according to claim 5 in which the knuckles of each leaf are located along diagonally opposite portions of the leaf body.

7. A connector assembly according to claim 5 in which the knuckles of each leaf are adjacent the same lengthwise edge of the leaf body.

8. A connector assembly according to claim 5 in which said securing means for each leaf passes through holes in the leaf body located along said center line of the body.

9. A connector assembly according to claim 8 in which the knuckles for each leaf extend outwardly relative to said opposite face of the leaf body a distance substantially equal to the thickness of such body.

10. A connector assembly according to claim 5 in which there are more than two said leaves all interconnected with vertical said pin means and arranged in a closed polygonal configuration when viewed from the top.

11. A connector assembly according to claim 6 in which there are an odd number of said leaves all interconnected with vertical said pin means in a closed polygonal configuration when viewed from the top.

* * * * *